US006293201B1

(12) United States Patent
Consaga

(10) Patent No.: US 6,293,201 B1
(45) Date of Patent: Sep. 25, 2001

(54) CHEMICALLY REACTIVE FRAGMENTATION WARHEAD

(75) Inventor: John P. Consaga, La Plata, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/443,119

(22) Filed: Nov. 18, 1999

(51) Int. Cl.[7] ..... F42B 12/52; F42B 12/48; F42B 12/42

(52) U.S. Cl. ..... 102/363; 102/363; 102/364; 102/367; 102/492; 102/506; 102/494; 149/109.6

(58) Field of Search ..... 102/363, 364, 102/473, 476, 389, 494, 367, 492, 506; 149/109.6

(56) References Cited

U.S. PATENT DOCUMENTS

| | | | | |
|---|---|---|---|---|
| 1,015,215 | | 1/1912 | Sokolowski . | |
| 3,728,174 | | 4/1973 | Reinhart | 149/21 |
| 3,951,066 | | 4/1976 | Schroeder | 102/65 |
| 4,106,410 | * | 8/1978 | Borcher et al. | 102/67 |
| 4,106,411 | * | 8/1978 | Borcher et al. | 102/67 |
| 4,172,031 | | 10/1979 | Hall et al. | 210/36 |
| 4,302,337 | | 11/1981 | Larson et al. | 210/662 |
| 4,331,080 | * | 5/1982 | West et al. | 102/301 |
| 4,547,234 | | 10/1985 | Takeuchi et al. | 149/3 |
| 4,706,568 | | 11/1987 | Lundwall et al. | 102/513 |
| 4,781,117 | * | 11/1988 | Garnett et al. | 102/493 |
| 4,835,105 | * | 5/1989 | Seres et al. | 435/97 |
| 5,114,506 | | 5/1992 | Consaga et al. | 149/88 |
| 5,454,891 | | 10/1995 | Preston | 149/109.6 |
| 5,468,313 | * | 11/1995 | Wallace, II et al. | 149/53 |
| 5,472,529 | | 12/1995 | Arita et al. | 149/2 |
| 5,639,987 | * | 6/1997 | Bereleau et al. | 149/19.8 |
| 5,652,409 | * | 7/1997 | Thompson et al. | 149/98 |
| 5,852,256 | | 12/1998 | Hornig | 102/473 |
| 6,059,906 | * | 5/2000 | Fleming et al. | 149/19.92 |
| 6,110,306 | * | 8/2000 | Consaga | 149/108 |

* cited by examiner

*Primary Examiner*—Michael J. Carone
*Assistant Examiner*—Lulit Semunegus
(74) *Attorney, Agent, or Firm*—Mark Homer

(57) ABSTRACT

A warhead has polar imbiber masses containing a complexed energetic composition of a cyclodextrin nitrate, a nitrate ester plasticizer, bismuth subsalicylate and a stabilizer that is dispersed into a cloud prior to target impact.

20 Claims, 2 Drawing Sheets

CHEMICALLY REACTIVE FRAGMENTATION WARHEAD

The invention described herein may be manufactured and used by or for the government of the United States of America for governmental purposes without the payment of any royalties thereon or therefor.

BACKGROUND OF THE INVENTION

1. Field of the Invention

The present invention relates to chemically reactive fragmentation warheads. More particularly, the fragmentation warheads of the present invention contain an energetic material of organic nitrate esters imbedded into a polar imbiber agent. Most particularly, the organic nitrate esters of the present invention are complexed with a nitrate ester plasticizer, bismuth subsalicylate and stabilizer to form highly energetic compositions with a stability and sensitivity suitable for use within a fragmentation warhead.

2. Brief Description of the Related Art

Several types of warheads are known. Previously known warheads include reactive metals housed within the casing of the warhead that react rapidly with the medium in which the explosion takes place, e.g., air, or with a material component of the target. U.S. Pat. No. 5,852,256 to Hornig discloses a non-focused blast explosive having a high explosive surrounded by an active metal that is capable of chemically interacting with the environment that is dispersed in fine particles when detonation occurs.

Other types of known warheads include chemically burning devices incorporated into void areas of a carrier, such as a polymer matrix. U.S. Pat. No. 3,951,066 to Schroeder discloses an incendiary fragmentation device with frangible but not detonatable incendiary material imbedded in a high explosive charge. U.S. Pat. No. 4,547,234 Takeuchi et al. discloses an explosive composition containing micro-voids.

Another type of warhead, known as fuel-air explosives, has an air combustible hydrocarbon, such as gasoline, disposed in a suitable tank surrounding a central charge of high explosive. Detonation of the high explosive disperses the hydrocarbon into a vapor cloud that is ignited by a secondary delayed charge. These warheads have significant handling and storage limitations, particularly with regard to leakage.

Fragmentation and scattering types of warheads use a high explosive center charge that fragments a surrounding material, such as a heavy steel outer casing. U.S. Pat. No. 1,015,215 to Sokolowski discloses a uniform projectile for guns in which scattering charges are embedded in plastic trinitrotoluol. U.S. Pat. No. 3,728,174 to Reinhart discloses hollow-resinous plastic spheres in a dynamite to provide resistance to collapse at high pressure. U.S. Pat. No. 4,706,568 to Lundwall et al. discloses a chemiluminescent lighting structure containing a plurality of smaller chemiluminiscent light sources.

Explosive compositions and propellants also are known. U.S. Pat. No. 5,114,506 to Consaga et al. discloses an energetic gun propellant or explosive composite having a solid nitrate ester of cyclodextrin and nitroglycerin. U.S. Pat. No. 5,454,891 to Preston discloses nitrated esters useful in explosives and gun propellants. U.S. Pat. No. 5,472,529 to Arita et al. discloses an explosive composition having an oxidizer, water and organic hollow microspheres, and a sensitizer composed of an organic or inorganic nitrates. U.S. Pat. No. 5,639,987 to Berteleau et al. discloses a solid propellant containing cellulose nitrate and nitroglycerin, with the use of bismuth salicylate. U.S. Pat. No. 5,652,409 to Thompson et al. discloses an uncomplexed double-base propellant having cyclodextrin nitrate, nitroglycerin, and bismuth salicylate in a double base propellant.

None of these patents discloses a reactive fragmentation warhead having a highly stable, safe handling composition that is detonated on impact. In view of the foregoing, there is a need for a warhead having a highly stable explosive energetic material that may be formed into a cloud and contact detonated. The present invention addresses this and other needs.

SUMMARY OF THE INVENTION

The present invention includes a chemically reactive fragmentation warhead comprising a plurality of polar imbiber masses and a complexed energetic composition of cyclodextrin nitrate, a nitrate ester plasticizer, bismuth subsalicylate and a stabilizer, wherein the complexed energetic composition is bound within the plurality of polar imbiber masses.

The present invention also includes an explosive cloud product made by the process comprising the steps of firing a missile having a chemically reactive fragmentation warhead thereon, the chemically reactive fragmentation warhead comprising a plurality of polar imbiber masses and a complexed energetic composition of cyclodextrin nitrate, a nitrate ester plasticizer, bismuth subsalicylate and a stabilizer, wherein the complexed energetic composition is bound within the plurality of polar imbiber masses; dispersing the plurality of polar imbiber masses from the chemically reactive fragmentation warhead to form a cloud; and, detonating the dispersed plurality of polar imbiber masses on impact with an object.

DETAILED DESCRIPTION OF THE PREFERRED EMBODIMENT

The present invention relates generally to energetic materials embedded in a polar imbiber mass material that is useful within a warhead. The energetic materials are complexed compositions of cyclodextrin nitrates, nitrate ester plasticizers, bismuth subsalicylate and stabilizers. The polar imbiber mass material is divided into units or a plurality of polar imbiber segments, such as beads that are dispersible from one another. The complexed composition is absorbed in the imbiber masses to allow dispersion of the complexed composition into a cloud that maximizes the released energy therefrom. As such, an explosive cloud is created from the dispersion of the polar imbiber masses. Detonation of the complexed composition embedded within the cloud of dispersed plurality of polar imbiber masses from the warhead increases the effectiveness of the warhead over a given area. While retaining extremely high energy of the energetic material that is detonated, the warhead also maintains high stability for safe handling and firing.

Figure 1:
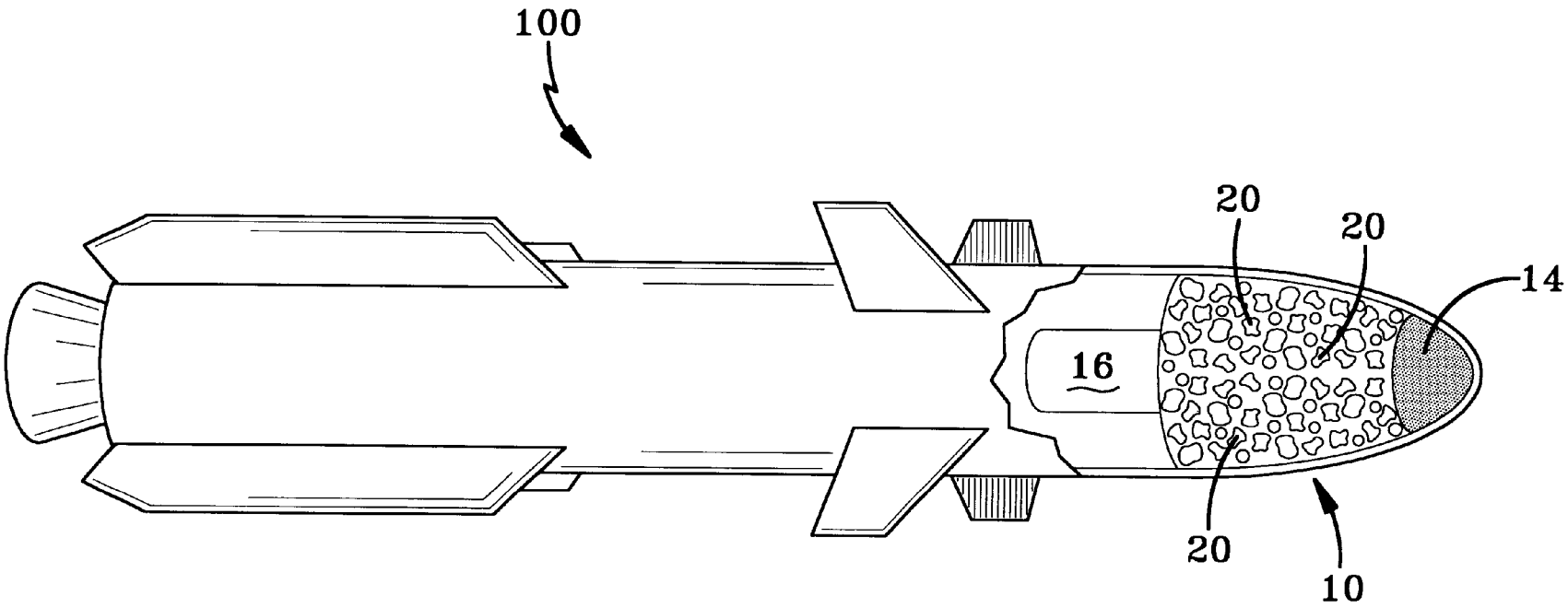
FIG. 1 illustrates a cross-sectional side view of the warhead of the present invention; and, FIG. 2 illustrates the cloud formation of multiple imbiber masses of the present invention after warhead launch that detonate on impact with a target.

As seen in FIG. 1, a chemically reactive fragmentation warhead 10 according to the present invention is shown. The warhead 10 on a missile 100 comprises a plurality of polar imbiber masses 20 containing a complexed energetic material of cyclodextrin nitrates, nitrate ester plasticizers, bismuth subsalicylate and stabilizer. The warhead 10 comprises a symmetrical shape for stabilized flight, with the plurality of polar imbiber masses 20 located within the outer shell 14 of the warhead 10. The symmetrical shape may be spherical, cylindrical, etc., effective to provide a uniform dispersion pattern of the imbiber masses 20, with a cylindrical shape of the warhead 10 preferred.

The warhead 10 comprises any suitable covering for adequate handling and firing characteristics, stabilized flight, and proper imbiber mass 20 cloud dispersal. Exemplary covering include metal, polymeric, i.e., plastic, or ceramic casings of a suitable design. The design of the warhead 10 includes flush, grooved, winged, aperture-type construction, and/or other known warhead 10 designs that allow proper operational characteristics. The warhead 10 may be machined from stock, casted, forged, or manufactured by known methods, with the determination of the proper design and manufacturing techniques determinable by those skilled in the art. For example, warhead 10 construction may include plastic cylindrical liners weighing 20 grams, having a diameter of 32 mm and a thickness of 0.6 to 0.9 mm. Other sizes and dimensions may be practiced with the present invention, with the proper sizes and dimensions suitable for particular munitions determinable by those skilled in the art. The warheads 10 of the present invention are useful on numerous munitions, including hand-held, vehicle mounted, and fixed systems, such as missiles, anti-tank weapons, tank rounds, etc.

The imbiber masses 20 comprise an absorbing material that swell with the incorporation of the complexed complex therein. The imbiber masses 20 are generally spherical in shape, but may include other shapes, such as polyhedrons, i.e., tetrahedrons or pyramids, or other shapes that may be easily dispersed from one another. Suitable compositions of the polar imbiber masses 20 may include absorbing latex polymer structures, such as polyvinyl chloride copolymers of vinyl chloride such as a copolymer of 60 weight percent vinyl chloride and 40 weight percent vinyl acetate; polymers and copolymers of vinylidene chloride including a copolymer of 75 percent vinylidene chloride and 25 percent acrylonitrile; acrylic polymers such as polymers of methylmethacrylate, ethyl acrylate and the like. Preferred are polar crosslinked copolymers of such alkylstyrenes and an alkyl ester derived from $C_1$ to $C_{24}$ alcohol and acrylic or methacrylic acid or mixture thereof. Suitable monomers which may be employed as comonomers with the alkylstyrene include such materials as methacrylic esters, arcylic esters, fumarate esters and half esters, maleate esters and half esters, itaconate esters and half esters, vinyl esters of aliphatic carboxylic acids, alkyl vinyl ketones, acrylonitrile, methacrylonitrile and the like.

The latex polymers composition of the imbiber masses 20 contain a slight amount of crosslinking agent, preferably in the range of from about 0.01 wt % to about 2 wt %, with more preferred ranges of from about 0.5 wt % to about 1.0 wt %, with a decrease in the level of crosslinking agent permitting the polymers to swell easily and imbibe a substantial volume of the complexed composition. With excessive amounts of crosslinking agent, the latex polymer is inhibited from imbibing sufficient quantities of the complexed composition. Latex polymer containing insufficient crosslinking agent tends to dissolve gradually in the complexed composition resulting, for example, into a non-discrete, non-particulate mass of polymer-thickened organic liquid.

Crosslinking agents may include polyethylenically unsaturated compounds such as divinylbenzene, diethylene glycol dimethacrylate, diisopropenylbenzene, diisoproppenyldiphenyl, diallylmaleate, diallylphthalate, allylacrylates, allylmethacrylates, allylfumarates, allylitaconates, alkyd resin types, butadiene or isoprene polymers, cycloocctadiene, methylene norbornylenes, divinyl phthalates, vinylisopropenylbenzene, divinylbiphenyl, as well as any other di- or poly-functional compounds known to be of use as a crosslinking agent in these polymeric vinyl addition compositions.

The latex polymers for the practice of the present invention may be prepared by emulsion polymerization processes that may be free radical catalyzed or initiated. Techniques for the preparation of such latexes are well known in the art, described for example, in U.S. Pat. Nos. 2,795,564; 2,914,499; 3,062,765; 3,177,173; 3,404,116; 3,480,578 and 3,882,230, the disclosures of which are herein incorporated by reference. Selection of latex polymer may be determined from a swelling index for the latex polymer particles for the complexed composition. The proper swelling index for a given polymer is determinable by those skilled in the art. A swelling index is readily determined as detailed in U.S. Pat. Nos. 4,172,031 to Hall et al. and 4,302,337 to Larson et al., the disclosures of which are herein incorporated by reference.

The sizes of the imbiber masses 20, containing the complexed composition, range in any suitable size for dispersion from the warhead 10, with the proper dimensions of the imbiber masses 20 determinable by those skilled in the art for a particular warhead 10 purpose. Preferably the size of the imbiber masses 20 ranges from about 125 microns to about 400 microns, more preferably from about 200 microns to about 375 microns, and most preferably from about 300 microns to about 350 microns. Imbiber masses in the form of beads may be obtained from IMTECH of St. Catharines, Ontario, Canada under the trademark Imbiber Beads®.

Bound within the imbiber masses 20 is a high explosive composition comprising the complexed compositions of cyclodextrin nitrates, nitrate ester plasticizers, bismuth subsalicylate and stabilizer. Liquid complexed compositions include an intermolecular attraction between the component parts of the composition, i.e., the cyclodextrin nitrates, nitrate ester plasticizers, bismuth subsalicylate and stabilizer are "tied" to one another within the complexed composition. As such, the component parts of the composition tend to act as a single ingredient or material, which may be evidenced by composition characteristics, such as a raised boiling point. By contrast, mixed components that are not complexed within a composition retain the individual characteristics of each component. Complexing may be imparted into the composition of the present invention with the addition of heat and mechanical energy, i.e., shear, under vacuum, in an appropriate medium, such as acetone. For example, the individual components of the present invention are mixed together in acetone or other like medium at an elevated temperature, with the medium selected for its ability to dissolve the components and be removed at modest temperatures, i.e., temperatures that are not damaging to the complexing components. Vacuum is applied while mechanical energy is placed into the component parts. Mechanical energy is preferably in the form of shear mixing, using shear blades to mix the composition. The acetone medium permits the components to dissolve, particularly the cyclodextrin nitrates. As low elevated temperatures strip the medium from the mixed components in an evacuated environment, the shearing complexes the components in the composition. Preferably, acetone is used with temperatures of from about 140° F. or higher, and pressures of from about 25–30 mm Hg that are continuously decreased to about 3 mm Hg over a period of from about 1 to about 4 hours.

Cyclodextrin nitrate compounds of the present invention include energetic materials such as α-cyclodextrin, β-cyclodextrin, γ-cyclodextrin, and mixtures thereof. The preferred cyclodextrin nitrate comprises γ-cyclodextrin nitrate. γ-cyclodextrin nitrate is particularly desirable because the maximum energy potential of the γ-cyclodextrin nitrate is significantly higher than other cyclodextrin nitrate compounds, while it retains significant stability. The γ-cyclodextrin nitrate, with 24 available —OH groups, possesses a larger cavity, allowing for approximately an 80% increase in cavity size from β-cyclodextrin nitrate, which has 21 —OH groups, and significantly greater increase over α-cyclodextrin with 18 —OH groups. Each D-glucose unit in a cyclodextrin compound has three free —OH groups capable of being nitrated to a nitrate ester group of —$ONO_2$. Preferably an average of from about 2 to about 3, more preferably from about 2.5 to about 3, and most preferably from about 2.6 to about 3 nitrate ester groups (—$ONO_2$) per D-glucose unit are present in the nitration product of the α-cyclodextrin, β-cyclodextrin or γ-cyclodextrin nitrate ester, either individually or within various mixtures thereof. Different α-cyclodextrin nitrate esters, based on the same basic α-cyclodextrin moiety, differ from each other in the degree of nitration, i.e., nitrate ester unit content. Likewise, different β-cyclodextrin nitrate esters differ from each other in the degree of nitration, as do different γ-cyclodextrin nitrate esters.

The cyclodextrins of the present invention may be nitrated using conventional techniques that are used in the preparation of nitrocellulose, with the degree of nitration controlled by varying the nitration conditions. Formation of the cyclodextrins is disclosed in U.S. Pat. No. 5,114,506 to Consaga et al., issued May 19, 1992, the disclosure of which is herein incorporated by reference. Commercial γ-cyclodextrins are available from Wacker-Bio-chem of Edieville, Iowa under the tradename Cavamax-W8.

The cyclodextrin nitrate esters of the present invention provide usefull replacements for energetic organic nitrate ester plasticizers within the energetic composition as the cyclodextrin nitrate esters increase the thermal stability and handling safety of the energetic composition of the organic nitrate ester plasticizers. The cyclodextrin nitrate esters also possess comparable or greater energy content than the organic nitrate ester plasticizers. As dry powders, the cyclodextrin nitrate esters are sensitive to electrostatic discharge (ESD), e.g., β-cyclodextrin nitrate ester (β-CDN) ($C_{42}H_{52}N_{18}O_{71}$) has an ESD value of only 0.0125 joules. When the organic nitrate ester plasticizer of 1,1,1-trimethylolethane trinitrate (TMETN), having an ESD value of 12.5 joules, is mixed with β-CDN (2:1 weight ratio), the resulting composite mixture has a liquid consistency and a resultant ESD value of 12.5 joules. The composite mixture, however, has improved handling characteristics.

The cyclodextrin starting materials comprise cyclic structures having 1,4-α-glucosidically linked D-glucose units, preferably being α-cyclodextrin with 6, β-cyclodextrin with 7, γ-cyclodextrin with 8 glucosidically linked D-glucose units, or mixtures of these compounds. A preferred embodiment of the present invention comprises an energetic composite comprising a nitrate ester of γ-cyclodextrin with a majority of the —OH groups fully nitrated, and an organic nitrate ester plasticizer of 1,1,1-trimethylolethane trinitate. Preferably, the weight ratio of the 1,1,1-trimethylolethane trinitate to the nitrate ester of γ-cyclodextrin ranges from about 2:1 to about 6:1 or less, and more preferably from about 2:1 to about 5:1.

The cyclodextrin nitrate preferably comprises from about 20 wt % to about 50 wt % of the complexed energetic composition, more preferably from about 25 wt % to about 40 wt %, and most preferably approximately 32.5 wt % of the complexed energetic composition.

Suitable nitrate ester plasticizers of the present invention that are complexed with the cyclodextrin nitrate are determinable by those skilled in the art, by considering the energy potential or sensitivity desired. Preferred energetic organic nitrate ester plasticizers include 1,1,1-trimethylolethane trinitate (TMETN), 1,2,4-butanetriol trinitrate (BTTN), triethylene glycol dinitrate (TEGDN), nitroglycerin (NG), 1,2-propyleneglycol dinitrate (PGDN), pentaerythritol trinitrate (PETRIN), diethylene glycol dinitrate (DEGN), and combinations or mixtures of these compounds. More preferred energetic organic nitrate ester plasticizers include the individual compounds or mixtures of 1,1,1-trimethylolethane trinitrate, 1,2,4-butanetriol trinitrate, triethylene glycol dinitrate, and nitroglycerin. Nitroglycerin is most preferred, which is commercially available from Naval Surface Warfare Center, Indian Head, Md.

Operable amounts of cyclodextrin nitrate ester to energetic organic nitrate ester plasticizer vary with the choice of cyclodextrin nitrate ester and energetic nitrate ester plasticizer, but generally range from about 1:1 to about 1:6 with amounts of 1:2, 1:3, and 1:4 operable with at least enough plasticizer to convert the powdery cyclodextrin nitrate ester into a liquid composition. With the combination of the cyclodextrin nitrate ester and nitrate ester plasticizer, the ESD of the nitrate ester plasticizer decreases to about that of the cyclodextrin nitrate ester while retaining the safer handling characteristics of the cyclodextrin nitrate ester. However, excessive amounts of the nitrate ester plasticizer cause a saturation point to be reached, after which the plasticizer remains separate or neat, i.e., not complexed, from the composition with the neat plasticizer retaining high shock sensitivity.

Generally, the amount of nitrate ester to nitrate ester plasticizer ranges from about 50 wt % to about 80 wt % of the complexed energetic composition, with amounts of from about 60 wt % to about 75 wt % more preferred, and an amount of approximately 65 wt % of the complexed energetic composition most preferred.

Bismuth subsalicylate is an acetone soluble complexing component with the cyclodextrin nitrate ester and nitrate ester plasticizer that provides a burn rate modifier to the energetic composition and a complex stabilizer. As such, the bismuth subsalicylate inhibits the breakup of the energetic composition into its component parts. This imparts significant safety to the energetic composition in storage, handling and manufacturing. Preferably, the bismuth subsalicylate comprises from about 0.75 wt % to about 1.5 wt % of the complexed energetic composition. Bismuth subsalicylate is commercially available from Pfaltz & Bauer, Inc. of Waterburg, Conn.

The stabilizer component of the present invention comprises a stabilizing compound having a pH of from about 7 or less to ensure decomposition of the nitrate ester does not occur. Preferably, the stabilizer comprises an acidic or neutral amide, with more preferred stabilizers including 2-nitrodiphenyl amine (2NDPA), methylnitroaniline (MNA) and/or combinations thereof. Preferred amounts of stabilizer range from about 1 wt % to about 2 wt % of the complexed energetic composition.

Increases in the amount of cyclodextrin nitrate ester, bismuth subsalicylate and/or stabilizer in relation to the nitrate ester plasticizer on average cause a decrease in the amount of available energy of the energetic composition. The appropriate relative amounts of these components for a particular energetic composition is determinable by those skilled in the art, generally as a factor of the liquidity and available energy of the complexed composition. As additional components tend to decrease the available energy within the complexed components, other energetic and non-energetic components generally are not added to control the liquidity and available energy of the complexed composition.

Preferred complexes of the cyclodextrin nitrate, nitrate ester plasticizer, bismuth subsalicylate and stabilizer comprise combinations of the γ-cyclodextrin nitrate and nitroglycerin complexed with the bismuth subsalicylate and stabilizer in amounts of from about 25 wt % to about 40 wt % γ-cyclodextrin nitrate, from about 60 wt % to about 75 wt % nitroglycerin, from about 1 wt % to about 2 wt % bismuth subsalicylate, and from about 1 wt % to about 2 wt % stabilizer. Most preferred energetic compositions include approximately 32.5 wt % γ-cyclodextrin nitrate, 65 wt % nitroglycerin, 1.05 wt % bismuth subsalicylate, and 1.4 wt % 2NDPA.

Figure 2:
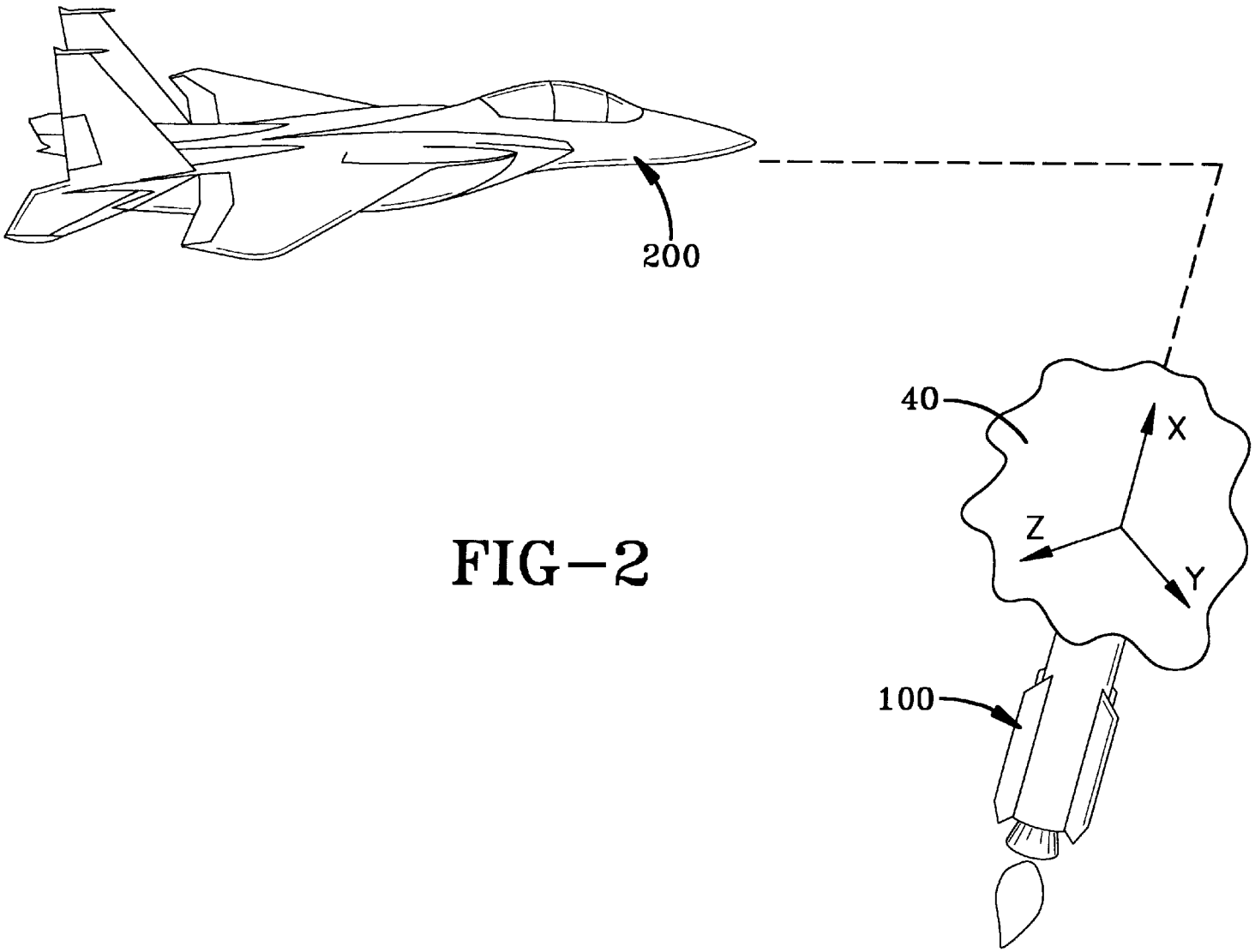

In operation, as shown in FIG. 2, the warhead 10 is attached to a missile 100 that is launched against a stationary or moving target 200. The cloud 40 formed by the present invention comprises the dispersed plurality of imbiber masses 20 from the warhead 10. Operationally, the present invention scatters the plurality of imbiber masses 20 containing the energetic material. As explosive material cloud 40 becomes dispersed over a relatively large area surrounding the point of dispersion, the cloud 40 travels along the direction of the warhead 10 towards a target 200. Within the cloud 40 of relatively small masses, the overall effectiveness becomes enhanced for a wide range of targets 200. As such, the present invention is particularly useful in warheads 10 for use against fast-moving or large area objects/targets 200, such as incoming missiles, aircraft, deployed mechanized armor, ships, large buildings, etc. With the impact of the dispersed plurality of imbiber masses 20 with the target 200, the dispersed high explosive within the imbiber masses 20 detonates to impact significant energy against the target 200, maximizing the explosive effect over a large area.

The plurality of imbiber masses 20 are dispersed into the cloud 40 by means of time, proximity, or impact fuses, that initiates a suitable dispensing means 16, shown in FIG. 1. Dispensing means 16 of the present invention include non-impact devices for spreading the imbiber masses 20 from the warhead 10. Non-impact devices include, without limitation, an unzipping or other uncovering mechanism for opening the warhead 10 during flight, gas generator devices for propelling or pumping the imbiber masses 20 into a dispersion, spinning means for lateral dispersal of the imbiber masses 20 from the missile 100, and other such non-impact devices, with the suitability of any particular device used as the dispersing means 16 for spreading the imbiber masses 20 determinable by those skilled in the art.

The dispersed plurality of imbiber masses 20 forms a cloud 40 that extends parallel, shown in FIG. 2 along the x-axis, and perpendicular, shown in FIG. 2 along the y-axis and z-axis, to the direction of travel of the warhead 10. The imbiber masses 20 may be dispersed to increase the bead density along any particular axis with the proportional axis density, i.e., the relative axis density amount of imbiber masses 20, with the preferred dispersion determinable by those skilled in the art. When used against a stationary target 200, the plurality of imbiber masses 20 preferably is expanded within the area along the y-axis and z-axis to maximize the area of contact of the target with the cloud 40. However, in many operational situations, such as anti-aircraft functions, the dispersion of the imbiber masses 20 from the warhead 10 that increases the density along the x-axis may be desired to create a large area cloud 40 in front of the moving target 200 and maximize the probability of contacting, i.e., hitting the target 200 at least with a portion of the imbiber masses 20. For other targets, it may be desirable to maximize the number of "hits" of imbiber masses 20 when the probability of contact is high, i.e., a dispersion over a launching missile from a fixed site. Most preferably, the cloud 40 is dispersed over a symmetrical area from the warhead 10 in a uniform distribution for universal use to maximize both hit and destruction probabilities. The degree of dispersion is proportional to the velocity of the imbiber masses 20 from the warhead 10, the speed of the warhead 10, and the time between the initiation of the dispersion and impact with the target. The size and density of the imbiber masses 20, and the chemical energy potential of the explosive composition, are most significant with regard to the energy release onto the target 200.

EXAMPLE 1

(Prophetic)

A polar latex polymer in the form of beads having an average size of approximately 50 microns is prepared and imbibed with a complexed composition of 32.5 wt % γ-cyclodextrin nitrate, 65 wt % nitroglycerin, 1.1 wt % bismuth subsalicylate, and 1.4 wt % 2NDPA to an average size of approximately 350 microns. The imbibed masses are loaded into a missile warhead, and the missile is fired at a target. In flight, the imbibed polymer beads are released from the warhead and scattered. On impact, the imbibed beads created a detonation with the contacted target.

The foregoing summary, description, example and drawings of the present invention are not intended to be limiting, but are only exemplary of the inventive features which are defined in the claims.

What is claimed is:

1. A chemically reactive fragmentation warhead comprising:

a plurality of polar imbiber masses; and, a complexed energetic composition of cyclodextrin nitrate, a nitrate ester plasticizer, bismuth subsalicylate and a stabilizer, wherein the complexed energetic composition is bound within the plurality of polar imbiber masses.

2. The chemically reactive fragmentation warhead of claim 1, wherein the cyclodextrin nitrate comprises an energetic material selected from the group consisting of α-cyclodextrin, β-cyclodextrin, γ-cyclodextrin, and mixtures thereof.

3. The chemically reactive fragmentation warhead of claim 2, wherein the cyclodextrin nitrate comprises γ-cyclodextrin nitrate.

4. The chemically reactive fragmentation warhead of claim 1, wherein the cyclodextrin nitrate comprises from about 5 wt % to about 30 wt % of the complexed energetic composition.

5. The chemically reactive fragmentation warhead of claim 4, wherein the cyclodextrin nitrate comprises from about 10 wt % to about 20 wt % of the complexed energetic composition.

6. The chemically reactive fragmentation warhead of claim 1, wherein the nitrate ester plasticizer comprises and energetic material selected from the group consisting of 1,1,1-trimethylolethane trinitate (TMETN), 1,2,4-butanetriol trinitrate (BTTN), triethylene glycol dinitrate (TEGDN), nitroglycerin (NG), 1,2-propyleneglycol dinitrate (PGDN), pentaerythritol trinitrate (PETRIN), diethylene glycol dinitrate (DEGN), and mixtures thereof.

7. The chemically reactive fragmentation warhead of claim 6, wherein the nitrate ester plasticizer comprises nitroglycerin (NG).

8. The chemically reactive fragmentation warhead of claim 1, wherein the nitrate ester plasticizer comprises from about 70 wt % to about 95 wt % of the complexed energetic composition.

9. The chemically reactive fragmentation warhead of claim 1, wherein the bismuth subsalicylate comprises from about 0.75 wt % to about 1.5 wt % of the complexed energetic composition.

10. The chemically reactive fragmentation warhead of claim 1, wherein the stabilizer comprises a stabilizing compound having a pH of from about 7 or less selected from the group consisting of 2-nitrodiphenyl amine (2NDPA), mononitroaniline (MNA) and combinations thereof.

11. The chemically reactive fragmentation warhead of claim 1, wherein the stabilizer comprises from about 1 wt % to about 2 wt % of the complexed energetic composition.

12. The chemically reactive fragmentation warhead of claim 1, wherein the masses comprise a spherical shape.

13. The chemically reactive fragmentation warhead of claim 1, wherein the masses comprise a size of from about 125 microns to about 400 microns.

14. The chemically reactive fragmentation warhead of claim 1, wherein the complexed energetic composition bound within the plurality of polar imbiber masses comprises from about 45% or more of the total weight of the bound masses.

15. A missile comprising the chemically reactive fragmentation warhead of claim 1.

16. An explosive cloud product made by the process comprising the steps of:

firing a missile having a chemically reactive fragmentation warhead thereon, the chemically reactive fragmentation warhead comprising a plurality of polar imbiber masses and a complexed energetic composition of cyclodextrin nitrate, a nitrate ester plasticizer, bismuth subsalicylate and a stabilizer, wherein the complexed energetic composition is bound within the plurality of polar imbiber masses;

dispersing the plurality of polar imbiber masses from the chemically reactive fragmentation warhead to form a cloud; and, detonating the dispersed plurality of polar imbiber masses on impact with an object.

17. The method of claim 16, wherein the cyclodextrin nitrate comprises γ-cyclodextrin nitrate.

18. The method of claim 16, wherein the nitrate ester plasticizer comprises nitroglycerin.

19. The method of claim 16, wherein the impacted object comprises a missile.

20. The method of claim 16, wherein the step of dispersing the plurality of polar imbiber masses comprises a dispersal means selected from the group consisting of unzipping the outside of the warhead, spinning release mechanisms, releasing gas from a gas generator within the warhead, and combinations thereof.

* * * * *